US006655439B2

(12) United States Patent
Parsonage

(10) Patent No.: US 6,655,439 B2
(45) Date of Patent: Dec. 2, 2003

(54) PREFORMED WINDOW TREATMENT

(76) Inventor: Diane E. Parsonage, 7403 Hour Glass Cir., Dallas, TX (US) 75252

( * ) Notice: Subject to any disclaimer, the term of this patent is extended or adjusted under 35 U.S.C. 154(b) by 0 days.

(21) Appl. No.: 10/000,044

(22) Filed: Oct. 18, 2001

(65) Prior Publication Data

US 2003/0075282 A1 Apr. 24, 2003

(51) Int. Cl.[7] ..... E04F 10/00
(52) U.S. Cl. ..... 160/38; 160/348
(58) Field of Search ..... 160/38, 39, 123, 160/124, 327, 330, 368.1, 348, 349.1, 349.2, 383, 405

(56) References Cited

U.S. PATENT DOCUMENTS

| | | | | | |
|---|---|---|---|---|---|
| 238,527 | A | | 3/1881 | Replogle | 160/38 |
| 333,408 | A | | 12/1885 | Hale | |
| 746,307 | A | | 12/1903 | Ebner | |
| 1,722,441 | A | | 7/1929 | Necker | |
| 2,123,745 | A | * | 7/1938 | Rosenberg | 160/348 |
| D130,327 | S | | 9/1941 | Lange | |
| 2,430,959 | A | | 11/1947 | Soff | 160/38 |
| 2,522,918 | A | * | 9/1950 | Abrams | 160/348 |
| 3,007,036 | A | | 10/1961 | Mills | 240/2 |
| D194,754 | S | | 3/1963 | Maras | D47/6 |
| 3,081,819 | A | * | 3/1963 | Lydard | 160/348 |
| 3,185,207 | A | * | 5/1965 | Humble | 160/348 |
| D295,935 | S | | 5/1988 | Estabrook | D6/578 |
| 5,074,348 | A | * | 12/1991 | Phillips | 160/38 |
| 5,092,384 | A | | 3/1992 | Easley | 160/126 |
| 5,117,891 | A | | 6/1992 | Simon | 160/263 |
| 5,152,331 | A | * | 10/1992 | Barone | 160/38 |
| 5,219,407 | A | | 6/1993 | Herring | 160/330 |
| 5,240,059 | A | | 8/1993 | White | 160/349.2 |
| 5,308,678 | A | | 5/1994 | Tsujimura et al. | 428/182 |
| 5,314,226 | A | | 5/1994 | Tovar | 296/97.7 |
| 5,345,990 | A | * | 9/1994 | Potts | 160/38 |
| 5,361,821 | A | * | 11/1994 | Barone | 160/39 |
| D355,556 | S | | 2/1995 | Graham | D6/578 |
| 5,503,209 | A | | 4/1996 | Healzer et al. | 160/38 |
| 5,505,245 | A | * | 4/1996 | Badalamenti | 160/38 |
| 6,173,752 | B1 | * | 1/2001 | Nelson et al. | 160/38 |

* cited by examiner

*Primary Examiner*—David Purol
(74) *Attorney, Agent, or Firm*—Gardere Wynne Sewell LLP

(57) ABSTRACT

The present invention provides a scalable, preformed, mold covered with fabric to form a window treatment. The fabric is cut to fit the mold and adhered to its contours in order to obtain the shape of the desired window treatment. The fabric can also have alignment tabs in order to make attachment to the mold easier. One or more rod hooks can be adhered to the fabric covering the mold or integrated into the mold. The rod hook attaches the window treatment to any standard curtain rod. Optional side extensions allow the creation of fuller pieces. The mold is designed to look attractive on the underside as well as the top side (front-back).

44 Claims, 6 Drawing Sheets

Fig.9A
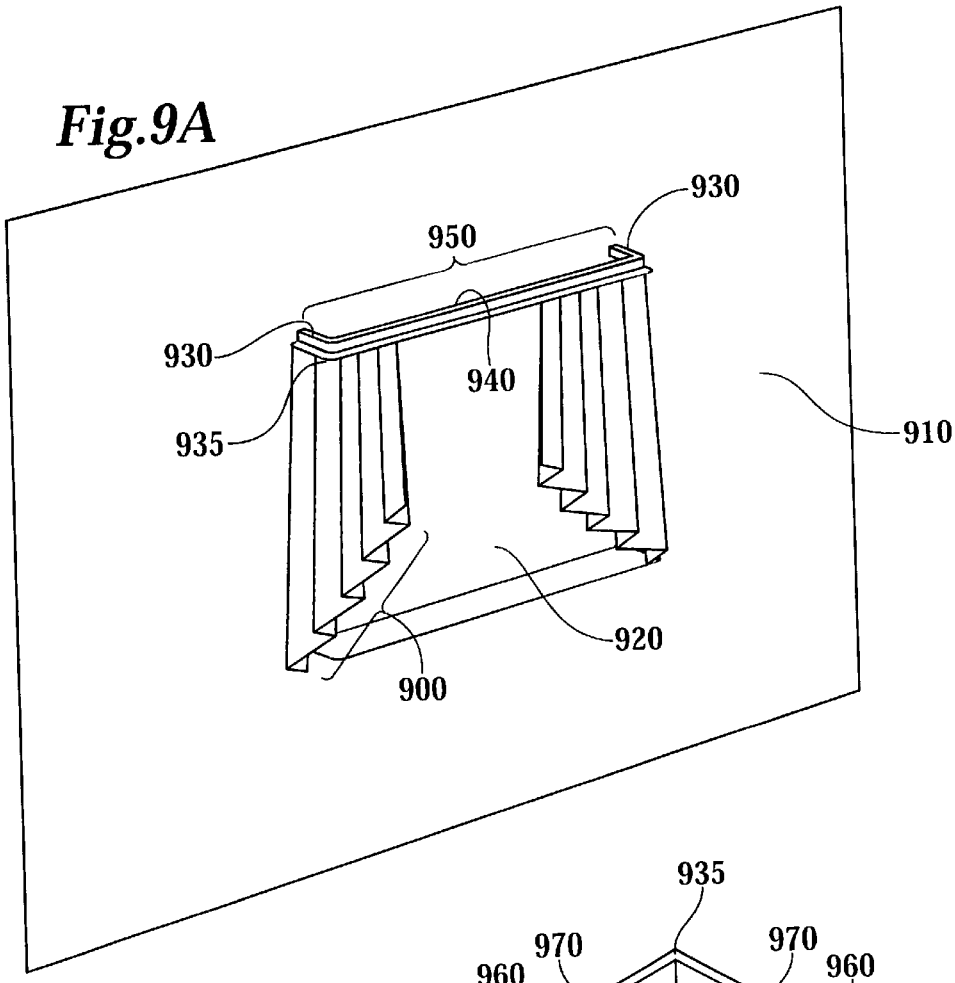
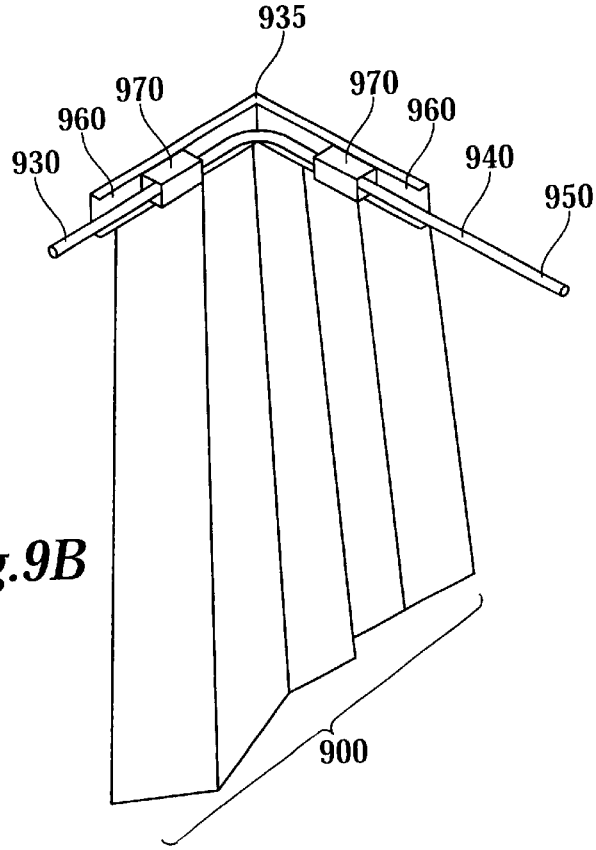
Fig.9B

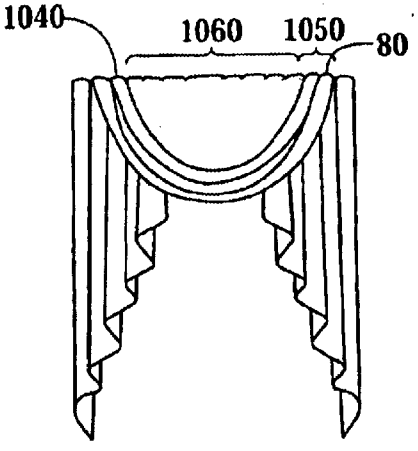
Fig.10A
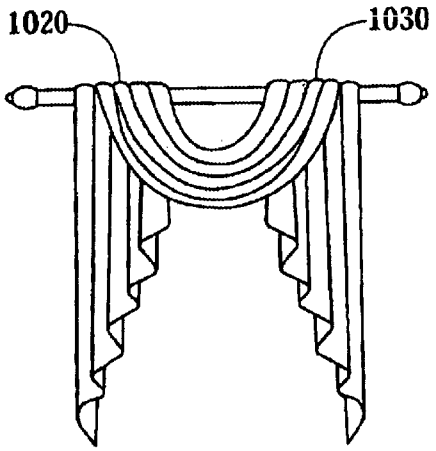
Fig.10B
Fig.10C
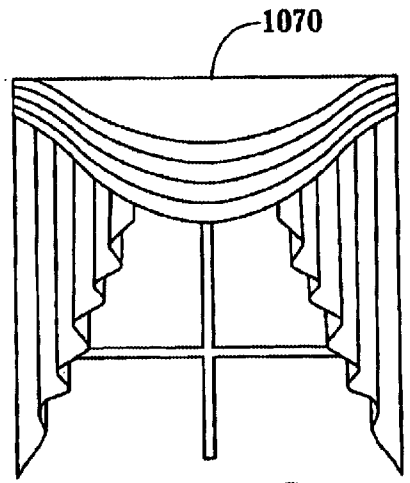
Fig.10D
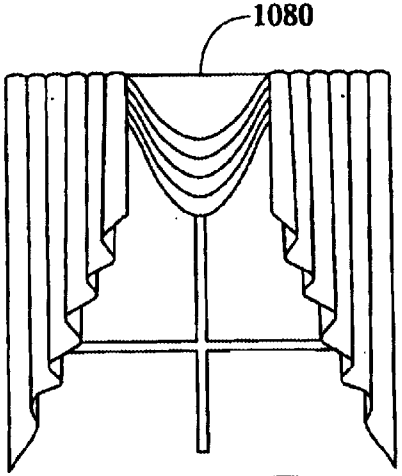
Fig.10E
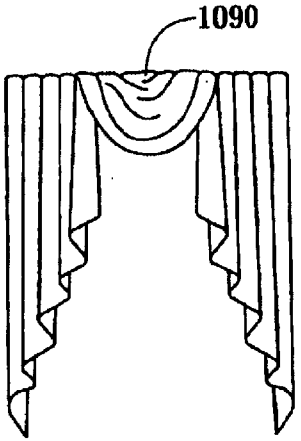
Fig.10F

PREFORMED WINDOW TREATMENT

FIELD OF THE INVENTION

The present invention relates generally to the field of window treatments and, in particular, to preformed window treatments.

BACKGROUND OF THE INVENTION

Consumers desiring to use window treatments are limited to either purchasing window treatments that are ready-made, which may or may not fully suit their tastes or needs, custom made, which are extremely expensive, or making their own. Even currently available do-it-yourself kits limit the consumers' fabric choices and may severely limit their size choices. Additionally, the available do-it-yourself kits do not ensure that the window treatment will be balanced (i.e. have evenly-spaced pleats/folds), which often results in an unattractive product. Moreover, current window treatments will often lose their shape when cleaned or vacuumed. Finally, currently available window treatments are not easily removed, replaced, modified or transported.

Accordingly, there is a need for a window treatment that allows the consumer unlimited fabric choice. There is a need for window treatments that can be economically created and customized to suit individual preferences. Additionally, there is a need for a window treatment that ensures the final product will be attractive and usable. There is also a need for window treatments that can be cleaned without losing their shape. Finally, there is a need for window treatments that can be easily removed, replaced, modified and transported.

SUMMARY OF THE INVENTION

The present invention provides a window treatment, a window treatment kit and method of creating a window treatment that allows the consumer unlimited fabric choice. The present invention provides window treatments that can be economically created and customized to suit individual preferences. Additionally, the present invention provides a method of creating window treatments that ensures the final product will be attractive, usable and easily reproducible. The present invention also provides window treatments that can be cleaned without losing their shape. Moreover, the present invention eliminates the need for measuring and sewing. Finally, the window treatment of the present invention can be easily removed, replaced, modified and transported.

More specifically, the present invention provides a scalable, preformed mold covered with fabric. The fabric is cut to fit the mold and adhered to its contours in order to obtain the shape of the desired window treatment. The fabric can also have alignment tabs in order to make attachment to the mold easier. One or more rod hooks can be either adhered to the fabric covering the mold or integrated into the mold. The rod hook can then be used to attach the window treatment to any standard curtain rod. Optional side extensions allow the creation of fuller pieces.

The present invention also provides a scalable, preformed, mold covered with fabric. The mold has one or more concentric humps. The fabric is cut to fit the mold and adhered to its contours in order to obtain the shape of the desired window treatment. Alignment tabs on the fabric make attachment to the mold easier. One or more rod hooks can be either adhered to the fabric covering the mold or integrated into the mold. The rod hook can then be used to attach the window treatment to any standard curtain rod.

In another embodiment, the present invention provides a method for creating window treatments. The steps are: cutting a piece of fabric to match a pattern, aligning the piece of fabric to a scalable preformed mold and adhering the piece of fabric to contours of the scalable preformed mold. The method may also include the step of attaching one or more rod hooks to the piece of fabric adhered to the scalable preformed mold if the rod hooks are not integrated into the mold.

In addition, the present invention provides a window treatment having multiple pieces, which can be of the same or differing sizes and/or configurations. Each piece is a scalable preformed mold covered by fabric. The multiple pieces are hung together using a rod hook to form a full window treatment.

Other features and advantages of the present invention will be apparent to those of ordinary skill in the art upon reference to the following detailed description taken in conjunction with the accompanying drawings.

BRIEF DESCRIPTION OF THE DRAWINGS

The above and further advantages of the present invention may be understood by referring to the following description in conjunction with the accompanying drawings in which corresponding numerals in the different figures refer to the corresponding parts in which:

FIGS. 9A and 9B depict an embodiment of a side extension and its connection to a window in accordance with the present invention; and FIGS. 10A–10F depict various shapes of the preformed mold in accordance with the present invention.

DETAILED DESCRIPTION OF THE INVENTION

While the making and using of various embodiments of the present invention are discussed herein in terms of swag window treatments, it should be appreciated that the present invention provides many applicable inventive concepts that can be embodied in a wide variety of specific contexts. The specific embodiments discussed herein are merely illustrative of specific ways to make and use the invention and are not meant to limit its scope in any way.

The present invention provides a window treatment, a window treatment kit and method of creating a window treatment that allows the consumer unlimited fabric choice.

The present invention provides window treatments that can be economically created and customized to suit individual preferences. Additionally, the present invention provides a method of creating window treatments that ensures the final product will be attractive, usable and easily reproducible. The present invention also provides window treatments that can be cleaned without losing their shape. Moreover, the present invention eliminates the need for measuring and sewing. Finally, the window treatment of the present invention can be easily removed, replaced, modified and transported.

Figure 1:
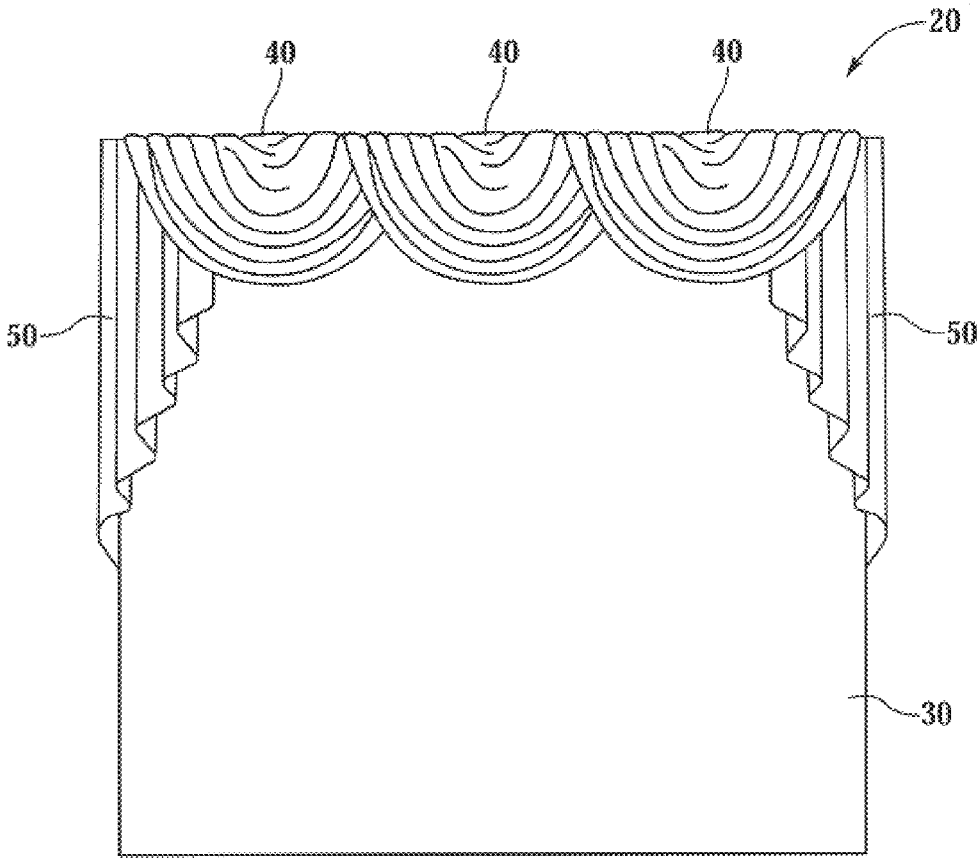
FIG. 1 depicts a representative swag window treatment in accordance with the present invention mounted on a window.
Figure 2:
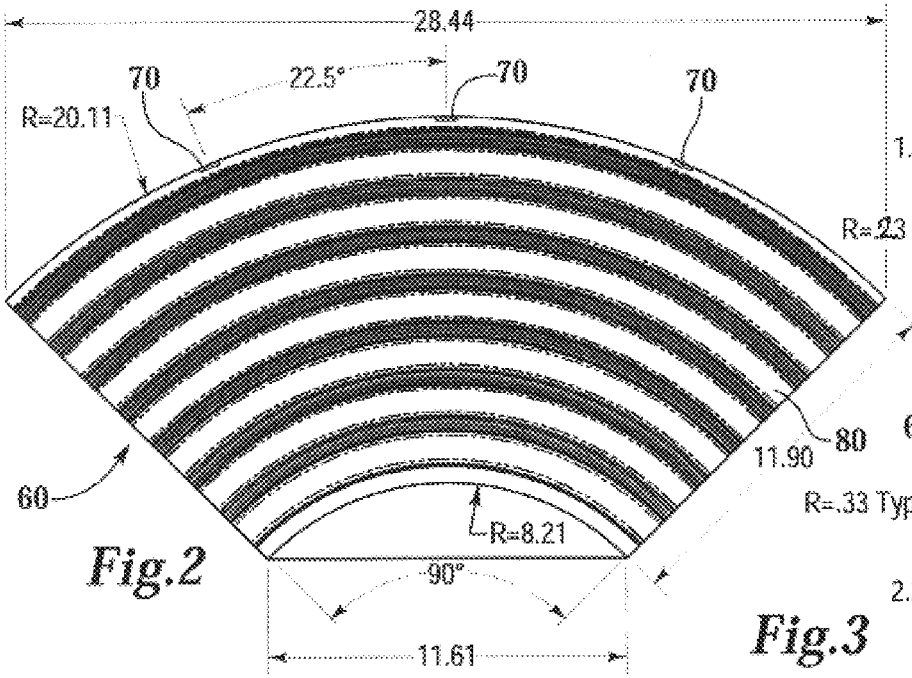
FIG. 2 depicts a front view of a mold form in accordance with one embodiment of the present invention.

FIG. 1 depicts a representative window treatment in accordance with the present invention mounted on a window 30. Swag window treatment 20 is shown with three (3) preformed window treatments 40 and two (2) cascade side extensions 50. FIG. 2 depicts a front view of a preformed mold form 60 in accordance with one embodiment of the present invention, which is used to create the window treatments 40 of the swag window treatment 20 as shown in FIG. 1. Preformed mold 60 is shown as a quarter-circle (90°) with three (3) alignment tabs 70 and evenly spaced concentric "humps," such as 80. The preformed mold 60 can be provided in any number of decorative shapes, such as semi-circular (shown), elliptical, U-shaped, large, small, with humps in the lower portion but not the top portion, etc. Exemplary preformed mold 60 measurements are also shown in FIG. 2. Alignment tabs 70 may be slots, markings or adhesives, such as VELCRO. Alignment tabs 70 may be located anywhere on preformed mold 60. Exemplary spacing and height of humps 80 are shown in FIG. 3.

Figure 3:
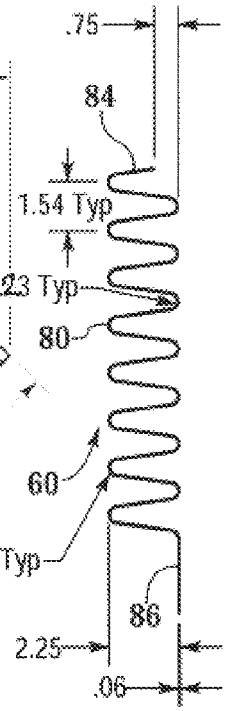
FIG. 3 depicts cross-sectional view of the mold form in accordance with one embodiment of the present invention.

The cross-sectional view in FIG. 3 shows a preformed mold 60 with eight (8) humps 80. Each hump 80 is of uniform height and depth and is equally spaced from each adjoining hump 80. Preformed mold 60 edge 84 corresponds to the shortest hump 80 (FIG. 2) of preformed mold 60 as shown in FIG. 2. Preformed mold 60 edge 86 corresponds to the longest hump 80 (FIG. 2) of preformed mold 60 as shown in FIG. 2. The dimensions of preformed mold 60 (FIGS. 2 and 3) allow easy alignment of patterned fabrics. For example, a stripe running in a straight vertical line down a piece of fabric will also run in a straight vertical line down a swag window treatment 40 (FIG. 1) when attached to preformed mold 60 (FIGS. 2 and 3) because of the preformed mold dimensions. The line will not waver from hump 80 (FIGS. 2 and 3) to adjoining hump 80 (FIGS. 2 and 3).

Preformed mold 60 can be less than a quarter-circle or more (for example, 180°). The preformed mold 60 may include one or more pieces that allow a multitude of shapes to be created. Moreover, the multiple preformed molds 60 can be overlapped. In addition, the preformed mold 60 can be formed in many decorative shapes as shown in FIGS. 10A–F. Moreover, preformed mold 60 can be formed from a variety of lightweight materials, such as a polymeric or fibrous material. In addition, preformed mold 60 can be formed through methods such as injection molding and vacuum formation. These methods result in a lightweight, semi-rigid to rigid preformed mold 60. An alternative material for use as the preformed mold 60 is a lightweight rubberized material. This alternative modifies the way the window treatment is assembled, but does not degrade the finished product. The size of the window treatment is scaled by the addition or removal of the humps 80. The humps 80 can be removed by cutting the preformed mold 60 or separating the humps 80 at preformed perforations in the preformed mold 60. In other words, more humps 80 result in a larger window treatment and less humps 80 make a smaller window treatment. Alternatively, the additional humps 80 can be attached to, abutted to, or overlapped to increase the size of the preformed mold 60. Multiple preformed molds 60 can also be used to cover larger window areas.

The present invention may be in the form of a kit. Such a kit could contain a preformed mold 60, a pattern matched to preformed mold 60 and one or more rod hooks. The rod hooks may be part of the preformed mold 60 or separate units as described in reference to FIGS. 9A and 9B. The kit could also contain an adhesive. The adhesive may be a separate component, integrated with the pattern or a combination thereof.

Figure 4:
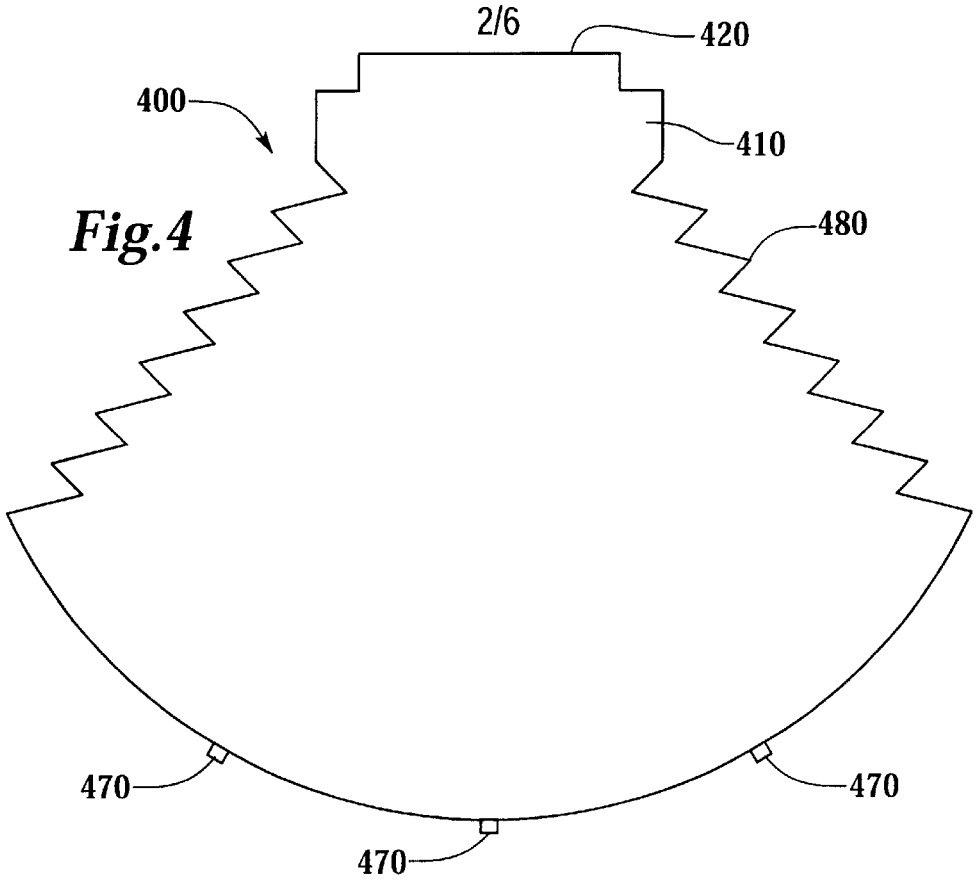
FIG. 4 depicts a pattern in accordance with one embodiment of the present invention.

The consumer can select any fabric for the window treatment. To assemble the window treatment, the consumer would have to cut a piece of fabric to conform to the desired window treatment style. For example, a swag treatment pattern 400 could appear as shown in FIG. 4. It would be basically fan-shaped. Its dimensions would vary to accommodate preformed mold 60. A larger fan-shaped swag treatment pattern 400 would be required to fit a larger preformed mold 60. Additionally, in order to facilitate attachment to the rod hook, a swag treatment pattern 400 would have an additional length of material 410 and 420 at the smaller end of the fan shape. Length of material 420 would wrap further around the rod hook then length of material 410. The attachment of the rod hook is discussed in greater detail in reference to FIGS. 6A, 6B and 6C, below. Alignment tabs 470 on the pattern 400 correspond to alignment tabs 70 (FIG. 2) on preformed mold 60 (FIG. 2). Each point, such as 480, would be mirrored on the opposite side of the pattern 400 and would correspond to a hump 80 (FIG. 2). The pattern 400 could also double as a method to adhere the fabric to preformed mold 60 (FIG. 2), thereby also providing additional shaping support. If the pattern 400 contains adhesive on both sides, one side can be affixed to the fabric to hold the pattern in place while the fabric is cut. Then, the adhesive on the other side can be used to adhere the fabric to the preformed mold. In this case, the pattern 400 would also require some form of "peel-away" backing over the adhesive in order to keep it from sticking to everything. Alternatively, a separate adhesive may be applied to either the fabric or preformed mold 60 (FIG. 2).

Figure 5:
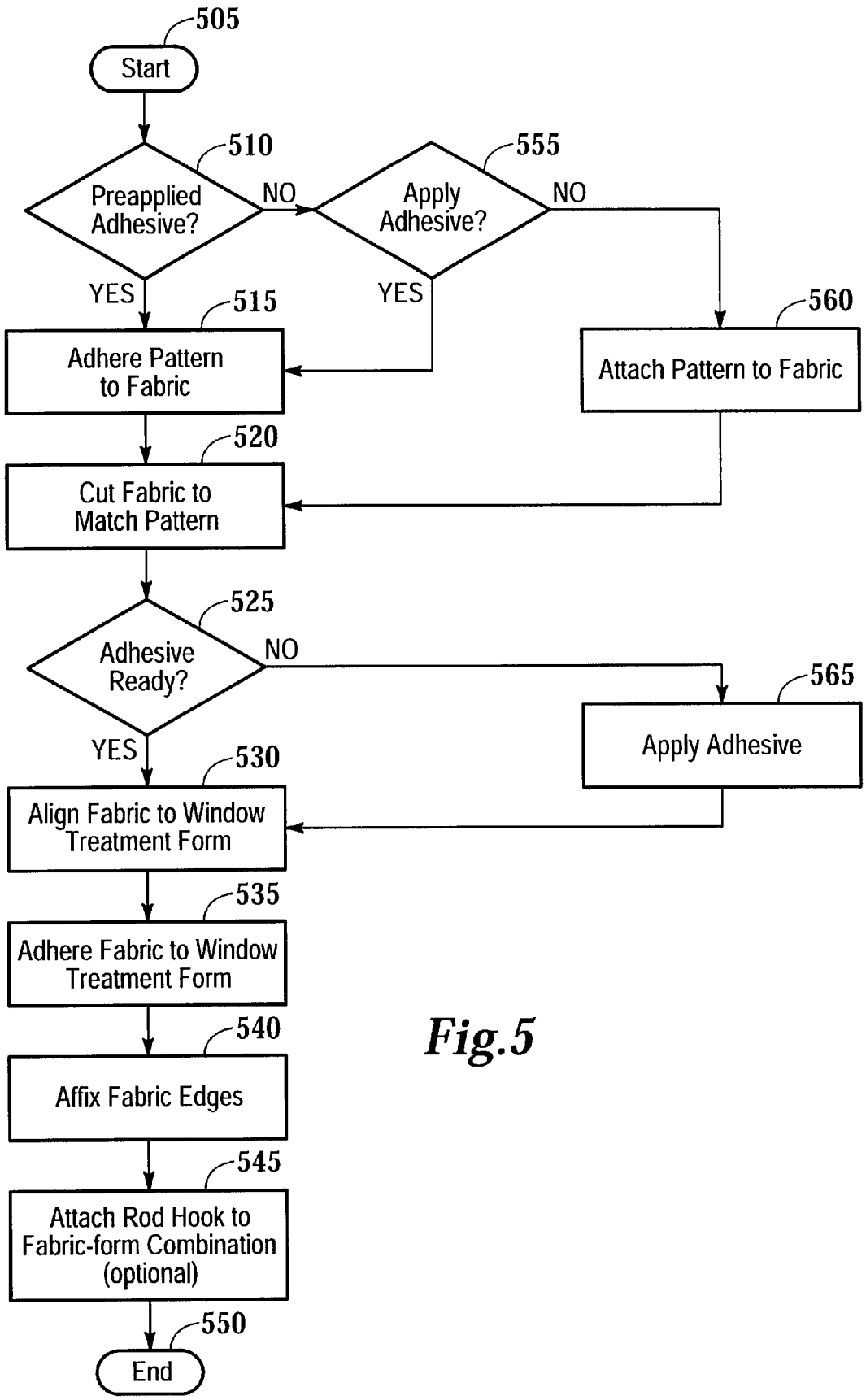
FIG. 5 depicts a flowchart of a method of creating a window treatment in accordance with the present invention.

A flowchart of the steps of an embodiment of the method for creating a window treatment is shown in FIG. 5. The assembly method begins in termination 505. If adhesive has been pre-applied to the pattern, as determined in decision point 510, the consumer adheres the pattern to a piece of fabric in block 515. If adhesive has not been pre-applied to the pattern, as determined in decision point 510, the consumer can either decide to apply adhesive, in decision point 555, and then proceed to adhere the pattern to a piece of fabric in block 515 or the consumer can attach the pattern to the piece of fabric in block 560 using an alternative method, such as pins. The consumer then cuts the fabric in accordance with the pattern in block 520. If the adhesive is already on the fabric, as determined in decision point 525, the consumer then aligns the fabric with the window treatment form in block 530. If the adhesive is not on the fabric, as determined in decision point 525, the consumer applies adhesive in block 565 and then aligns the fabric with the window treatment form using the alignment tabs on the fabric and those on preformed mold 60 (FIG. 2) in block 530. Not only do the alignment tabs correctly align the fabric to preformed mold 60 (FIG. 2), but they also help to ensure that patterned fabrics, particularly stripes, appear balanced and aligned after attachment to preformed mold 60 (FIG. 2). The consumer next adheres the fabric to the window treatment form in block 535.

For a semi-rigid to rigid preformed mold 60 (FIG. 2), beginning at one end of preformed mold 60 (FIG. 2) and moving individually to each adjoining hump 80 (FIG. 2), the consumer then smoothes the fabric, pressing lightly but firmly, along the contours of each hump 80 (FIG. 2) until each hump 80 (FIG. 2) is covered in fabric. The fabric edges are affixed in block 540. More specifically, the fabric along longest hump 80 (FIG. 2) or edge 84 (FIG. 3) is affixed to the preformed mold 60 (FIG. 2) by tucking the fabric edges into a lip of the preformed mold 60 (FIG. 2), thus creating a finished edge. Both sides of preformed mold 60 (FIG. 2) can be covered in fabric in this manner. Alternatively, two preformed molds 60 having fabric on opposing sides can be attached or cupped together wherein the fabric edges are tucked in between the cupped preformed molds 60 (FIG. 2). An adhesive may be used in either method to further secure the fabric. The fabric does not need to be identical on each side (front and back). Further, longest hump 80 (FIG. 2) or edge 84 (FIG. 3) of preformed mold 60 (FIG. 2 or FIG. 3) can be narrower to allow for the addition of such decorative accents as fringe. In the case where preformed mold 60 (FIG. 2) is a quarter-circle, the fabric will form folds extending up and out from preformed mold 60 (FIG. 2), making the quarter-circle into a half-circle.

If the rod hooks 70 (FIG. 2) are not already attached to or integrated with the preformed mold 60 (FIG. 2 or FIG. 3), the rod hooks are attached in block 545. The rod hook attachment process is describe in more detail in reference to FIGS. 6A–6C. A single window treatment fabric-mold assembly is then complete in termination 550.

In the case of preformed mold 60 (FIG. 2) made of rubberized material, or other material having a positional memory, the fabric attachment procedure would differ slightly. A pattern might not be necessary, because rubberized preformed mold 60 (FIG. 2) could be temporarily stretched out to a flattened state and used as its own pattern. Whether or not a pattern is used to cut the material, the actual fabric to rubberized preformed mold 60 (FIG. 2) attachment would be performed by stretching rubberized preformed mold 60 (FIG. 2) to a flattened state, adhering the fabric to rubberized preformed mold 60 (FIG. 2) and then releasing rubberized preformed mold 60 (FIG. 2). This allows rubberized preformed mold 60 (FIG. 2) to resume its preformed molded shape and to shape the adhered fabric into the desired configuration.

Figure 6A:
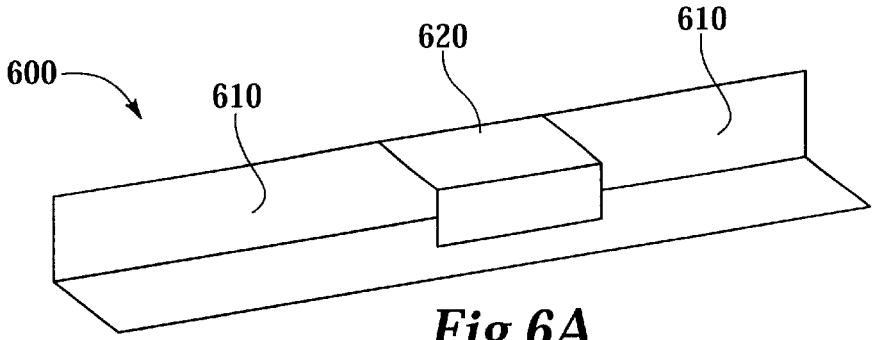
FIGS. 6A, 6B and 6C depict an embodiment of a rod hook and its connection to a window treatment in accordance with the present invention

An embodiment of a rod hook 600 as a piece of semi-rigid to rigid material, the length of which preferably matches the longest edge of the fabric-mold combination is illustrated in FIG. 6A. The rod hook 600 may be a single attachment, primarily L-shaped, although other configurations, such as a square or circle can be used. The L-shaped sections 610 of such a rod hook extend in from each end toward the center, each L-shaped section 610 ending at an opposite inner edge of shortest hump 80 (FIG. 2) of preformed mold 60 (FIG. 2). L-shaped sections 610 allow individual preformed molds 60 (FIG. 2) to overlap by enabling each rod hook 600 to lay on top of another rod hook 600, under another rod hook 600 or adjacent to another rod hook 600. This allows the consumer to adjust the width of multiple piece window treatments, such as that shown in FIG. 1. From each inner edge of shortest hump 80 (FIG. 2) of preformed mold 60 (FIG. 2), the rod hook 600 is preferably C-shaped, although other configurations that would enable the rod hook 600 to be easily hooked to and unhooked from any standard curtain rod can be used. The C-shaped section 620 enables the rod hook 600 to clip to any standard curtain rod. The rod hook 600 is attached to the fabric-mold combination along the top edge of the fabric-mold combination. One method of attachment would be adhesive. The sections of the rod hook 600 to which fabric will be attached could be pre-coated with adhesive (and possibly covered with a "peel-away" backing) or the consumer could apply the adhesive.

Figure 6B:
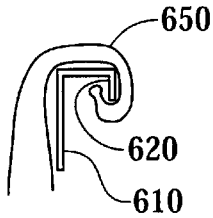
Figure 6C:
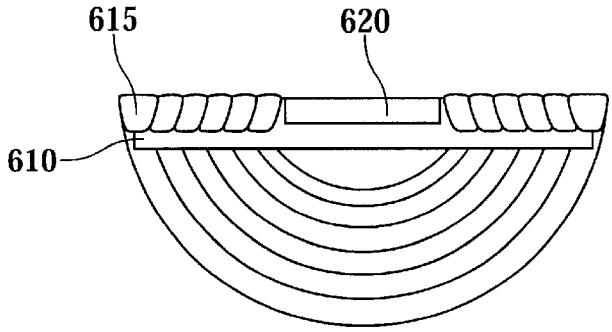

In either case, the rod hook 600 is positioned on the material such that the outer edge forming the C-shape section 620 on the rod hook is approximately twice its size from the free edge of the extended fabric piece. The C-shaped section 620 is disposed between two (2) L-shaped sections 610. For example, if the edge forming the C-shape section 620 is a half-inch in size, then that edge would be attached approximately one inch from the free edge of the extended fabric piece. The remaining one inch of fabric is then smoothed along and wrapped around the C-shaped section 620 and attached along the inside of the C-shaped section 620 as shown in FIG. 6B. Next, while holding the fabric firmly against the inside of the C-shaped section 620, the consumer pulls the fabric 650 taut and rolls the rod hook up, adhering the back edge of the C-shaped section 620 and short leg of the L-shaped section 610 to the fabric 650. Finally, continuing to hold the fabric 650 taut, the consumer rolls the rod hook 600 further up, adhering the long-leg of the L-shaped section 610 to the fabric 650. From the side, the resulting attachment appears as in FIG. 6B, with fabric 650 adhered to and pulled taut against both C-shaped section 620 and L-shaped section 610. From the back, the window treatment appears as in FIG. 6C with fabric folds 615 adhered to both L-shaped section 610 and C-shaped section 620. The single piece window treatment is complete. Multiple fabric-covered preformed molds 60 (FIG. 2) can be combined to create window treatments of various sizes and configurations, such as that as shown in FIG. 1.

Figure 7:
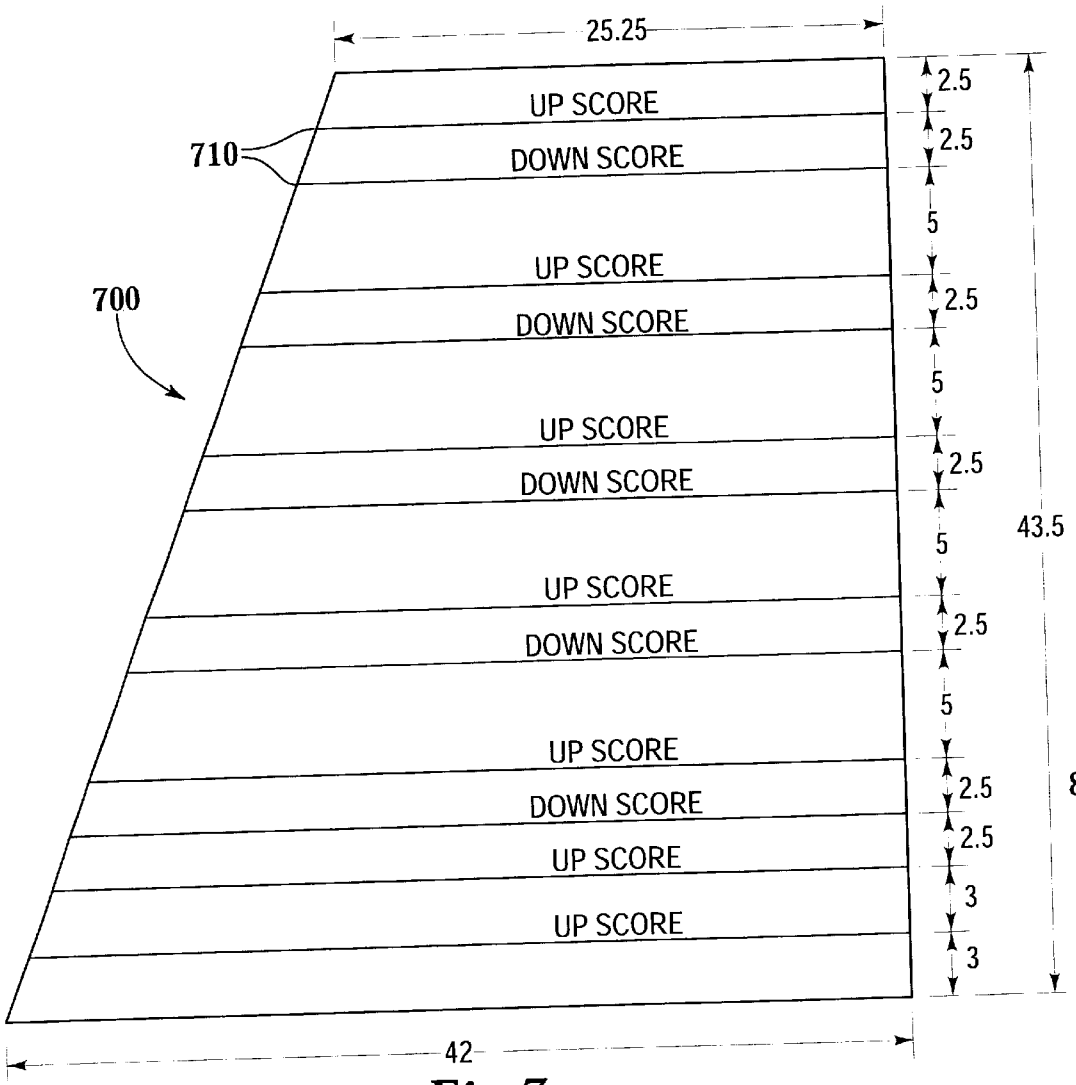
FIG. 7 depicts an expanded view of the scoring of a side extension piece in accordance with the present invention.

Side extensions, such as those shown as cascades 50 in FIG. 1, can be used to form additional decorative accents. The material used to form the preformed mold of the side extensions must be capable of holding its shape but not appear stiff. Such a material would have characteristics similar to TYVEK. Cascades 50 (FIG. 1) are pleated. In order to form even, balanced pleats, side extension pieces should be scored and folded along balanced lines. FIG. 7 depicts an expanded view of the scoring, such as 710, of a side extension piece 700 of the present invention. Exemplary measurements are also shown in FIG. 7.

Figure 8:
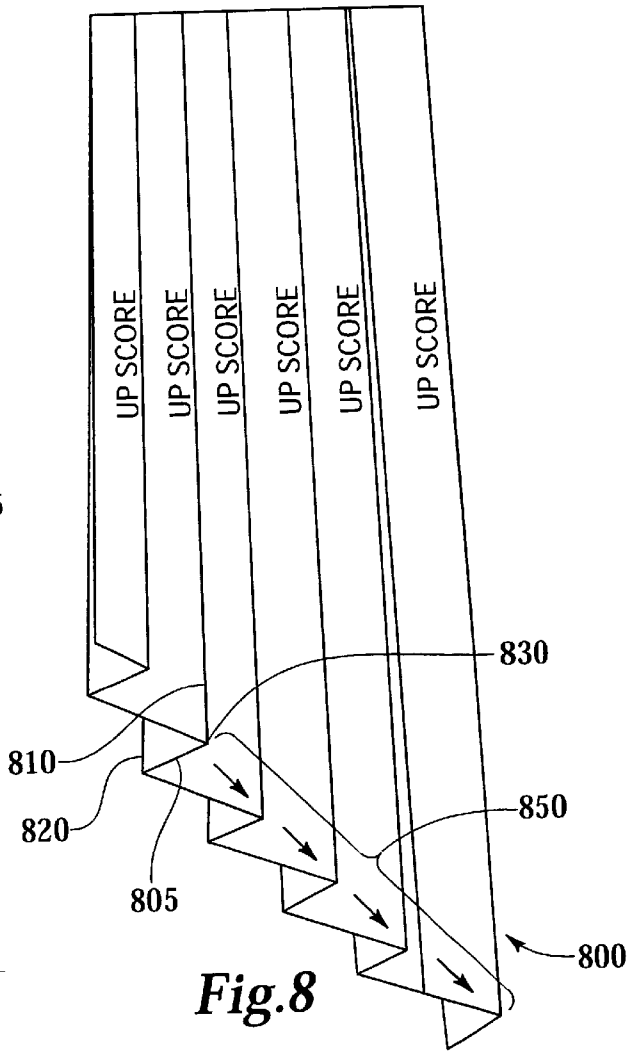
FIG. 8 depicts a cross-sectional view of the scoring of a side extension piece in accordance with the present invention.

FIG. 8 depicts a cross-sectional view of the scoring of a side extension piece 800 of the present invention. Up-score 810 forms the visible side of pleat 805. Pleat point 830 is formed at the intersection of up-score 810 and down-score 820. Down-score 820 forms the underside of pleat 805. Successive pleats 850 are formed from linked up-scores and down-scores. Pleats 805 and 850 are folded flat on top of each other. Fabric is cut to fit a pattern matched to the side extension piece 800 core, shown expanded as side extension piece 700 (FIG. 7). The fabric is attached to the side extension piece 800 core in its expanded state as shown in FIG. 7. The side extension piece 800 core then resumes its shape, giving the appearance of pleats. The side extension piece 800 core material may also function as a pattern. The side extension piece 800 core material may also have an adhesive pre-applied and covered with a "peel-away" backing. This pre-applied adhesive would be used to attach the fabric to the side extension piece 800 core.

Side extension piece 900 may lay flat (i.e. parallel to the window and the wall). Alternatively, side extension piece 900 may conform to the contours of the portion of a standard curtain rod that connects to the wall. For example, as shown in FIG. 9A, a standard curtain rod has side pieces 930 and length piece 940. The standard curtain rod with sides pieces 930 and length piece 940 may connect to a wall 910 at one end of each side piece 930. Side pieces 930 extend perpendicular to wall 910 for a length of one or more inches and then form a right angle 935 parallel to wall 910, turning to span window 920 with length piece 940. Side extension pieces 900 may connect to either or both ends of length piece 940 and then may conform to the right angle and, as one continuous piece, also connect to either or both side pieces 930.

A rod hook with L-shaped sections 960 and C-shaped sections 970 for side extension piece 900 is shown in FIG. 9B. C-shaped sections 970 attach to standard curtain rod 950. Side extension piece 900 is adhered to L-shaped sections 960 and C-shaped sections 970 as described above in relation to FIGS. 6A and 6B. The rod hook with L-shaped sections 960 and C-shaped sections 970 may be a single attachment. Configurations other than L-shaped or C-shaped can be used as long as side extension piece 900 can be attached to the rod hook and the rod hook can be easily attached to and removed from standard curtain rod 950. Standard curtain rod 950 has a length piece 940 and two (2) side pieces 930 (only one is shown). A single attachment rod hook for side extension piece 900 could have "bend points" at differing locations in order to conform the rod hook to right angle turn 935. Right angle 935 can occur at varying distances from approximately one or more inches from a wall, such as 910 in FIG. 9A. Alternatively, separate rod hooks could be used to attach side extension piece 900 to side piece 930 and the rest of side extension piece 900 to length piece 940.

Now referring to FIGS. 10A–10F, various shapes of the preformed mold 60 are shown in accordance with the present invention. FIG. 10A depicts an implementation of the present invention using a semi-circular shaped preformed mold 1010. FIG. 10B depicts an implementation of the present invention using a preformed mold 1020 that is hung over a pole-type rod 1030. FIG. 10C depicts an implementation of the present invention using a semi-circular shaped preformed mold 1040 having humps 80 in the lower portion 1050 and no humps in the upper portion 1060. FIG. 10D depicts an implementation of the present invention using an elliptical shaped preformed mold 1070. FIG. 10B depicts an implementation of the present invention using a U-shaped preformed mold 1080. FIG. 10F depicts an implementation of the present invention using a small semi-circular shaped preformed mold 1090 without lower humps.

While specific alternatives to steps of the present invention have been described herein, additional alternatives not specifically disclosed but known in the art are intended to fall within the scope of this invention. Thus, it is understood that other applications of the present invention will be apparent to those skilled in the art upon the reading of the described embodiments and a consideration of the appended claims and drawings.

What is claimed is:

1. A window treatment comprising:

a scalable preformed mold, the scalable preformed mold comprising one or more shaping contours; and a fabric covering adhered and conformed to the shaping contours of the scalable preformed mold, the fabric covering shaped to fit the shaping contours of the scalable preformed mold.

2. The window treatment as recited in claim 1 further comprising one or more rod hooks adhesively attached to the fabric covering at a top end of the scalable preformed mold, the rod hooks attachable to any standard curtain rod.

3. The window treatment as recited in claim 1 further comprising one or more rod hooks integrated into the scalable preformed mold, the rod hooks attachable to any standard curtain rod.

4. The window treatment as recited in claim 1 wherein the shaping contours comprise one or more concentric humps.

5. The window treatment as recited in claim 4 wherein the one or more concentric humps are semi-circular.

6. The window treatment as recited in claim 4 wherein the one or more concentric humps are elliptical.

7. The window treatment as recited in claim 1 wherein the scalable preformed mold further comprises one or more alignment tabs along an edge of the scalable preformed mold.

8. The window treatment as recited in claim 1 wherein the fabric covering further comprises one or more alignment tabs along an edge of the fabric covering.

9. The window treatment as recited in claim 1 wherein the scalable preformed mold is injection-molded.

10. The window treatment as recited in claim 1 wherein the scalable preformed mold is a rubberized material.

11. The window treatment as recited in claim 2 further comprising one or more side extensions attached to one or more ends of a rod hook.

12. The window treatment as recited in claim 1 further comprising at least one additional scalable preformed mold, the additional scalable preformed mold abutting the shaping contours of the scalable preformed mold.

13. The window treatment as recited in claim 1 wherein the shaping contours of the scalable preformed mold comprise one or more perforations.

14. A window treatment comprising:

a scalable preformed mold, the scalable preformed mold comprising one or more concentric humps and one or more alignment tabs along an edge of the scalable preformed mold;

a fabric covering adhesively attached and conformed to the concentric humps of the scalable preformed mold, the fabric covering shaped to fit the scalable preformed mold and further comprising one or more alignment tabs along an edge of the fabric covering.

15. The window treatment as recited in claim 14 further comprising one or more rod hooks adhesively attached to the fabric covering at a top end of the scalable preformed mold, the rod hooks attachable to any standard curtain rod.

16. The window treatment as recited in claim 14 further comprising one or more rod hooks integrated into the scalable preformed mold, the rod hooks attachable to any standard curtain rod.

17. The window treatment as recited in claim 14 wherein the one or more concentric humps are semi-circular.

18. The window treatment as recited in claim 14 wherein the one or more concentric humps are elliptical.

19. A method for creating a window treatment, the steps comprising:

cutting a piece of fabric to match a pattern;

aligning the piece of fabric to a scalable preformed mold, the scalable preformed mold further comprising one or more shaping contours; and adhering the piece of fabric to the shaping contours of the scalable preformed mold.

20. The method for creating a window treatment as recited in claim 19 further comprising the step of attaching a rod hook to the piece of fabric adhered to the shaping contours of the scalable preformed mold.

21. The method for creating a window treatment as recited in claim 19 wherein the pattern further comprises an adhesive on both a top side and a bottom side, one side to adhere to the fabric covering and one side to adhere to the shaping contours of the scalable preformed mold.

22. The method for creating a window treatment as recited in claim 19 wherein the scalable preformed mold is injection-molded.

23. The method for creating a window treatment as recited in claim 19 wherein the scalable preformed mold is a rubberized material.

24. The method for creating a window treatment as recited in claim 19 wherein the shaping contours of the scalable preformed molds comprise one or more concentric humps.

25. The method for creating a window treatment as recited in claim 24 wherein the one or more concentric humps are semi-circular.

26. The method for creating a window treatment as recited in claim 24 wherein the one or more concentric humps are elliptical.

27. The method for creating a window treatment as recited in claim 19 further comprising the step of separating the piece of fabric from the pattern.

28. The method for creating a window treatment as recited in claim 19 wherein the shaping contours of each scalable preformed mold comprise one or more perforations.

29. The method for creating a window treatment as recited in claim 28 further comprising the step of separating at least one shaping contour of at least one scalable preformed mold along at least one perforation.

30. A window treatment comprising:

two or more scalable preformed molds, each scalable preformed mold further comprising one or more shaping contours, wherein each scalable preformed mold abuts or overlaps at least one other scalable preformed mold; and two or more fabric coverings adhesively attached and conformed to the shaping contours of each scalable preformed molds, each fabric covering shaped to fit the shaping contours of each scalable preformed mold.

31. The window treatment as recited in claim 30 further comprising one or more rod hooks adhesively attached to the fabric covering at a top end of the scalable preformed mold, the rod hooks attachable to any standard curtain rod.

32. The window treatment as recited in claim 30 further comprising one or more rod hooks integrated into the scalable preformed mold, the rod hooks attachable to any standard curtain rod.

33. The window treatment as recited in claim 30 wherein the shaping contours of the scalable preformed molds comprise one or more concentric humps.

34. The window treatment as recited in claim 33 wherein the one or more concentric humps are semi-circular.

35. The window treatment as recited in claim 33 wherein the one or more concentric humps are elliptical.

36. The window treatment as recited in claim 30 wherein the scalable preformed molds are injection-molded.

37. The window treatment as recited in claim 30 wherein the scalable preformed molds are a rubberized material.

38. The window treatment as recited in claim 30 wherein the scalable preformed molds each further comprise one or more alignment tabs along an edge of each scalable preformed mold.

39. The window treatment as recited in claim 30 wherein the fabric coverings further comprise one or more alignment tabs along an edge of each fabric covering.

40. A kit for creating a window treatment, the kit comprising:

a scalable preformed mold; and a pattern to be used in conjunction with a fabric.

41. The kit for creating a window treatment as recited in claim 40 further comprising one or more rod hooks attachable to any standard curtain rod.

42. The kit for creating a window treatment as recited in claim 40 further comprising an adhesive.

43. A window treatment comprising:

a scalable preformed mold, the scalable preformed mold comprising one or more concentric humps and one or more alignment tabs along an edge of the scalable preformed mold;

a fabric covering adhesively attached and conformed to the concentric humps of the scalable preformed mold, the fabric covering shaped to fit the scalable preformed mold and further comprising one or more alignment tabs along an edge of the fabric covering; and one or more rod hooks adhesively attached to the fabric covering at a top end of the scalable preformed mold, the rod hooks attachable to any standard curtain rod.

44. A window treatment comprising:

a scalable preformed mold, the scalable preformed mold comprising one or more concentric humps and one or more alignment tabs along an edge of the scalable preformed mold;

a fabric covering adhesively attached and conformed to the concentric humps of the scalable preformed mold, the fabric covering shaped to fit the scalable preformed mold and further comprising one or more alignment tabs along an edge of the fabric covering; and one or more rod hooks integrated into the scalable preformed mold, the rod hooks attachable to any standard curtain rod.

* * * * *